US009738362B2

(12) United States Patent
Ketterman et al.

(10) Patent No.: US 9,738,362 B2
(45) Date of Patent: Aug. 22, 2017

(54) FLOW FIN

(71) Applicant: Hobie Cat Company, Oceanside, CA (US)

(72) Inventors: Gregory Scott Ketterman, Carlsbad, CA (US); James Taylor Czarnowski, Fallbrook, CA (US); Jason Christopher Kardas, Oceanside, CA (US); Philip James Dow, Oceanside, CA (US); Drew William Brackett, Carlsbad, CA (US); Shane Yellin, Oceanside, CA (US); John Thomas Myers, III, Encinitas, CA (US)

(73) Assignee: Hobie Cat Company, Oceanside, CA (US)

( * ) Notice: Subject to any disclaimer, the term of this patent is extended or adjusted under 35 U.S.C. 154(b) by 0 days.

(21) Appl. No.: 15/189,728

(22) Filed: Jun. 22, 2016

(65) Prior Publication Data

US 2017/0021904 A1 Jan. 26, 2017

Related U.S. Application Data

(60) Provisional application No. 62/195,450, filed on Jul. 22, 2015.

(51) Int. Cl.
*B63H 1/36* (2006.01)
*B63H 1/32* (2006.01)
(Continued)

(52) U.S. Cl.
CPC ..... *B63H 1/32* (2013.01); *B63B 35/79* (2013.01); *B63B 35/7943* (2013.01); *B63H 1/36* (2013.01);
(Continued)

(58) Field of Classification Search
CPC ..... B63H 19/02; B63H 9/0607; B63H 1/36; B63H 1/37
See application file for complete search history.

(56) References Cited

U.S. PATENT DOCUMENTS 35,451 A 6/1862 Johnson
2,173,415 A 6/1939 Hill, Jr.
(Continued)

FOREIGN PATENT DOCUMENTS

DE 3001502 7/1981
DE 3301943 A1 7/1984
(Continued)

OTHER PUBLICATIONS

Howe, "Penguin Power Bids to Challenge the Propeller", The Boston Globe, May 13, 1997, pp. C1, C2.

*Primary Examiner* — Andrew Polay
(74) *Attorney, Agent, or Firm* — Joseph E. Mueth

(57) ABSTRACT

A human propelled watercraft having a pair of flexible fins supported by a mast extending into the water each adapted to oscillate through an arcuate path in a generally transverse direction with respect to the central longitudinal dimension of said watercraft. Pedals are provided for applying input force whereby as input force is applied, the flexible fins can twist to form an angle of attack for providing forward thrust with respect to the longitudinal dimension of the watercraft while moving in both directions along the arcuate path. Each of the fins preferably is composed of a layer of stiff and durable material that is wrapped around the mast. The two layers of material touch at the trailing edge and they are free to slide relative to each other. Preferably, each of the fins is provided with adjustable tensioning at the tip of the mast.

9 Claims, 7 Drawing Sheets

(51) Int. Cl.

| | |
|---|---|
| ***B63B 35/79*** | (2006.01) |
| ***B63H 16/18*** | (2006.01) |
| *B63B 35/71* | (2006.01) |
| *B63H 16/20* | (2006.01) |

(52) U.S. Cl.
CPC ..... *B63H 16/18* (2013.01); *B63B 35/71* (2013.01); *B63H 2016/202* (2013.01)

(56) References Cited

U.S. PATENT DOCUMENTS

| | | | |
|---|---|---|---|
| 2,286,914 | A | 6/1942 | Knapp |
| 2,873,713 | A | 12/1955 | Bastrup |
| 2,948,255 | A | 8/1960 | Sbrana |
| 3,032,001 | A | 5/1962 | Kiker, Jr. |
| 3,095,850 | A | 7/1963 | Stolzer |
| 3,695,211 | A | 10/1972 | Gross |
| 3,845,733 | A | 11/1974 | Jackman |
| 4,172,427 | A | 10/1979 | Kindred |
| 4,318,700 | A | 3/1982 | Price |
| 4,474,502 | A | 10/1984 | Daoud |
| 4,490,119 | A | 12/1984 | Young |
| 4,511,338 | A | 4/1985 | Fanelli |
| 4,635,577 | A | 1/1987 | Palmquist |
| 4,936,802 | A | 6/1990 | Ueno |
| 4,960,396 | A | 10/1990 | Stolzer |
| 5,183,422 | A | 2/1993 | Guiboche |
| 5,194,024 | A | 3/1993 | Shiraki |
| 5,460,551 | A | 10/1995 | Beres |
| 6,022,249 | A | 2/2000 | Ketterman et al. |
| 6,050,868 | A | 4/2000 | McCarthy |
| 6,755,706 | B1 | 6/2004 | Lin |
| 7,637,791 | B2 | 12/2009 | Ketterman et al. |
| 2014/0328682 | A1* | 11/2014 | Thouret ..... F16H 21/40 416/78 |
| 2016/0052610 | A1 | 2/2016 | Ketterman et al. |

FOREIGN PATENT DOCUMENTS

| | | | |
|---|---|---|---|
| DE | 3431660 | A1 | 3/1986 |
| GB | 452719 | | 8/1936 |
| GB | 1192917 | | 5/1970 |
| GB | 2049594 | A | 12/1980 |
| JP | 52-33290 | | 3/1977 |
| JP | 1-156194 | | 6/1989 |
| JP | 1-144198 | | 10/1989 |
| JP | 3-035897 | | 8/1991 |
| JP | 2007-186046 | A | 7/2007 |

* cited by examiner 1
11
11

1
27
27
15

1
27
27
11
11
b
C
C
14
12
15

7
11
12
1
a
a
16

FLOW FIN

This patent application claims the benefit of U.S. Provisional Patent Application 62/195,450, filed Jul. 22, 2015, the disclosure of which is expressly incorporated herein by reference.

FIELD OF THE INVENTION

The present invention relates generally to the means of propelling a vessel and more specifically it relates to the design of a thrust producing oscillating fin.

BACKGROUND OF THE INVENTION

Oscillating fin propulsion has been used to produce efficient propulsion. This technology appears in U.S. Pat. No. 6,022,249 and U.S. Pat. No. 7,637,791 the text and drawings of which are expressly incorporated herein by reference, which discloses a novel water craft, such as a kayak or a stand up craft, which typically include a hull having propulsion means extending below the water line. The propulsion means comprises a pair of fins each having a leading edge and a trailing edge and adapted to oscillate through an arcuate path in a generally transverse direction with respect to the central longitudinal dimension of the watercraft. Foot operated pedals are operatively associated with the propulsion means for applying input force to the propulsion means. The propulsion means includes a pair of fins which twist to form an angle of attack for providing forward thrust with respect to the longitudinal dimension of the watercraft while moving in both directions along the arcuate path.

The existing fin designs are limited to relatively soft and flexible material to allow the flex and twist to assume the shape of a propeller blade.

The existing fin designs are solid and the weight is directly related to the volume.

The existing fin designs have generally a square tip end and is tapered span wise. The cord at the root of the current fin designs is larger than the cord at the tip end.

SUMMARY OF INVENTION

Briefly, this invention comprises a fin for providing propulsion force to a watercraft having a mast carrying a fin which oscillates through an arcuate path in a generally transverse direction with respect to the central longitudinal dimension of the watercraft, said fin comprising a thin sheet of material adapted to wrap around the mast to form the leading edge and having trailing edges that are touching but free to slide relative to each other.

This invention further comprises in a watercraft having propulsion means extending below the water line comprising a pair of flexible fins each having a leading edge and a trailing edge, each fin being supported at its leading edge by a mast, each fin being adapted to oscillate through an arcuate path in a generally transverse direction with respect to the central longitudinal dimension of said watercraft, and means operatively associated with said propulsion means for applying input force to said propulsion means whereby as input force is applied said flexible fins can twist to form an angle of attack for providing forward thrust with respect to the longitudinal dimension of the watercraft while moving in both directions along said arcuate path, the improvement wherein each of said fins is made of a thin sheet of material wrapped around said mast to form the leading edge, said each of said fins having trailing edges that are touching but are free to slide relative to each other, said thin sheet of material being bent 90° to close the tip end to form a hollow chamber.

In another aspect, this invention comprises in a watercraft having propulsion means extending below the water line comprising a pair of flexible fins each having a leading edge and a trailing edge, each fin being supported at its leading edge by a mast, each fin being adapted to oscillate through an arcuate path in a generally transverse direction with respect to the central longitudinal dimension of said watercraft, and means operatively associated with said propulsion means for applying input force to said propulsion means whereby as input force is applied said flexible fins can twist to form an angle of attack for providing forward thrust with respect to the longitudinal dimension of the watercraft while moving in both directions along said arcuate path, the improvement wherein each of said fins has a thick airfoil section profile generally conforming to NACA0015 to provide more efficient propulsion.

NACA0015 is a foil section specified by the National Advisory Committee for Aeronautics. The 15 indicates that the foil is 15% thick and the 00 indicates that the foil has no camber.

Still further, this invention comprises in a watercraft having propulsion means extending below the water line comprising a pair of flexible fins each having a leading edge and a trailing edge and adapted to oscillate through an arcuate path in a generally transverse direction with respect to the central longitudinal dimension of said watercraft, and means operatively associated with said propulsion means for applying input force to said propulsion means whereby as input force is applied said flexible fins can twist to form an angle of attack for providing forward thrust with respect to the longitudinal dimension of the watercraft while moving in both directions along said arcuate path, the improvement wherein each of said fins is provided with means at the tip of the mast to provide adjustable tensioning of the trailing edge.

In a preferred embodiment, the invention comprises a watercraft having propulsion means extending below the water line comprising a pair of flexible fins each having a leading edge and a trailing edge, each fin being supported at its leading edge by a mast, each fin being adapted to oscillate through an arcuate path in a generally transverse direction with respect to the central longitudinal dimension of said watercraft, and means operatively associated with said propulsion means for applying input force to said propulsion means whereby as input force is applied said flexible fins can twist to form an angle of attack for providing forward thrust with respect to the longitudinal dimension of the watercraft while moving in both directions along said arcuate path, the improvement wherein each of said fins is made of a thin sheet of material wrapped around said mast to form the leading edge, said each of said fins having trailing edges that are touching but are free to slide relative to each other and having means at the tip of the mast to provide adjustable tensioning of the trailing edge, only one of said trailing edges of each fin being tensioned to enhance deformation, twist and camber of each fin.

The fin is hollow. The tip of the fin is preferably shaped so that it is rounded and smooth. The fin design of this invention allows a much tougher and stiffer fin material and yet still allows the fin to twist and flex to assume a more efficient shape. The key to the flexibility is the fact that the trailing edges are free to move relative to each other. If the trailing edges were not free the fin would be too stiff. In this invention, a tough and stiff imperforate material is used which has been found to increase durability and gain flexibility with changes in geometry.

The fin by itself has very little resistance to twist (torsion), but when the fin is part of the assembly, the assembly puts the fin in tension. This tension is created between the tip of the mast and the clew. The clew is the corner of the fin at the base near the trailing edge. As this tension is increased the fin becomes stiffer.

The fin is also relatively flexible (cord-wise flexibility) so that the camber can change. This flexibility is a result of the trailing edges being free to slide relative to each other. The relaxed shape of the fin is to have no camber. Under load the fin flexes to have positive camber.

The invention comprises a fin design that allows a lighter structure with the use of a shell type structure. The invention uses less but tougher and stiffer material to reduce weight and improve performance.

In this invention, each said fin has a square tip but with a constant cord span wise. The effect is to maximize the surface of the fin with a given span length. The result is an improved efficiency of the fin and more compact design.

It has been found that a thick airfoil section profile is beneficial and that a thinner fin is more susceptible to stall or turbulence on the low pressure side of the fin which is not efficient.

Since the fin is hollow there is no compromise to weight, cost or stiffness to make the fin thicker.

The hollow structure and the free trailing edges of the fin of this invention allows generally the section profile to change while oscillating and have positive camber. The positive camber enhances the performance of the fin.

Preferably, each mast is provided with a threaded means at the mast tip to provide adjustable tensioning of the trailing edge. The invention more preferably comprises a fin design where only one of trailing edges of each fin is tensioned when the fin is oscillating. This has been found to provide more flexibility on the slack side of the fin and enhance the deformation, twist and camber of the fin.

The present invention is applicable to a pedaled kayak or a stand up craft propelled by the action of two transversely oscillating fins or sails. As the force on the pedals is increased, the less restrained end of the fins or sail twists to assume a propeller like shape. As the fins or sails oscillate, they change pitch or shape upon reaching the end of their arcuate movement, viz, when they simultaneously reverse direction of movement at the opposite ends of their arcuate pathway. This sail action is somewhat similar to what happens when tacking in a sailboat in that the sails exert, in both of their directions of movement, a forward thrust component.

The kayak has a generally elongated hull having a cockpit, a seat located such that the hip of the user is substantially fully below the upper deck of the kayak. The cockpit also contains a set of pedals adapted to be pushed, first one and then the other, by the user's feet. The hull is also provided with a rudder and tiller.

A stand up craft can be propelled with the drive. The user stands on a pair pedals and alternately applies force to each pedal. The board has a rudder to steer the board. The board also has a set of handle bars to aid balance on the board. Controls for the rudder are placed on the handle bars.

The pedals are operatively connected by pedal shafts to the propulsion means which extends through a vertically disposed compartment in the center of the hull.

The fin is oscillated from a pivot point near the base of its mast. This motion induces a velocity field perpendicular to the fin that increases in strength proportional to the distance from the base. In order to achieve efficient lift (avoid stall and operate near optimal Lift Coefficient), the fin must twist in a manner proportional to the increased perpendicular flow speed. It has been found that having a wide cord length at the tip (essentially square-top design and constant cord span wise) and a thick profile (essentially an airfoil profile) creates the desired fin twist and thus more efficient propulsion.

Optimized cord-wise flexibility of the fin for more efficient lift generation. Just as proper cord-wise hydrodynamic foil shape is important on an airplane wing, or the sail shape on a sailboat, having an efficient lifting surface is necessary for the fin to operate efficiently. Airfoils, like the NACA0015 typically have a cross-section where the maximum thickness, (or in the case of a sail, maximum outward curve) is located about ⅓ of the local cord length back from the leading edge. Like a sail, and unlike most commercial foil sections, the fin of U.S. Pat. No. 6,022,249 is flexible. This flexibility requires that the fin stiffness and shape, combined with the surrounding flow-field, determine the shape of the foil during operation.

In the present invention, an innovative geometry based on a shell structure connected at the leading edge and free to move at the trailing edge creates a cord-wise flexibility that results in an efficient fin shape during operation. The improvement is the use of a single material, a simpler structure and a thicker foil section. This construction significantly enhances performance.

The present invention provides an adjustable mast length which is a fin tensioning device to allow for customized peddling resistance for various operators and optimized hydrodynamic performance for different vessel lengths. The fin tension is the tension in the fin between the tip of the mast and the bottom aft corner of the fin. The fin tension affects the shape and therefore performance of the fin. Increasing the fin tension effectively makes the fin stiffer and increases the angle of attack of the fin meeting the water which creates more lift and more resistance on the pedal. The mast length adjusting device located on the tip of mast and accessible by a hole at the tip of the fin is easily adjusted by the user.

The more specific improvement wherein, due to the shell structure, the tensioning has a significant impact on the resistance on the pedal. The resistance on the pedal can be adapted to the operator and/or the type of craft used. Larger, stronger operators, operators that wish to peddle at a slower cadence, or fins used on longer, faster vessels may prefer to operate with more tension. Those who prefer to peddle at a higher frequency, less powerful peddlers, or operators of shorter and slower boats may prefer less fin tension.

THE DRAWINGS

Figures 10, 11, 12, 12A:
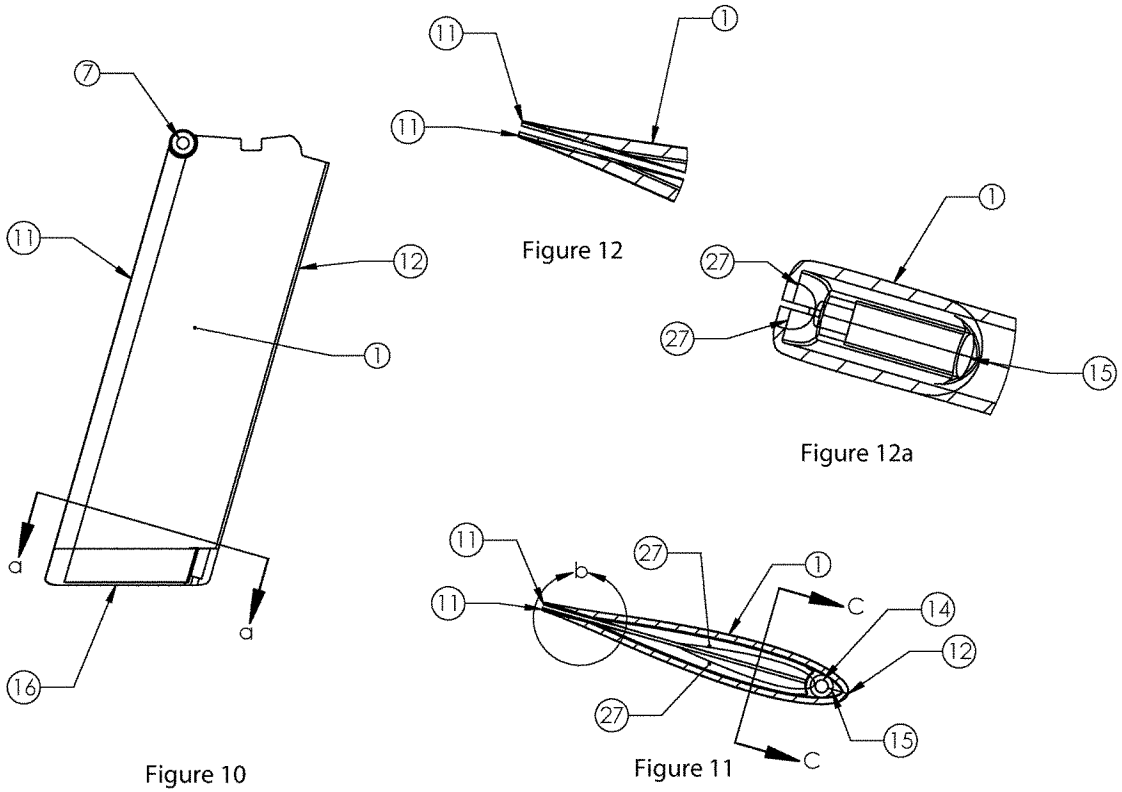
FIG. 10 is a plain view of the top end of the fin.
FIG. 11 is a sectional view taken at "a-a" of FIG. 10.
FIG. 12 is a sectional view taken at "b" of FIG. 11.

FIG. 12*a* is a sectional view taken at "c-c" of FIG. 11.

Figure 13:
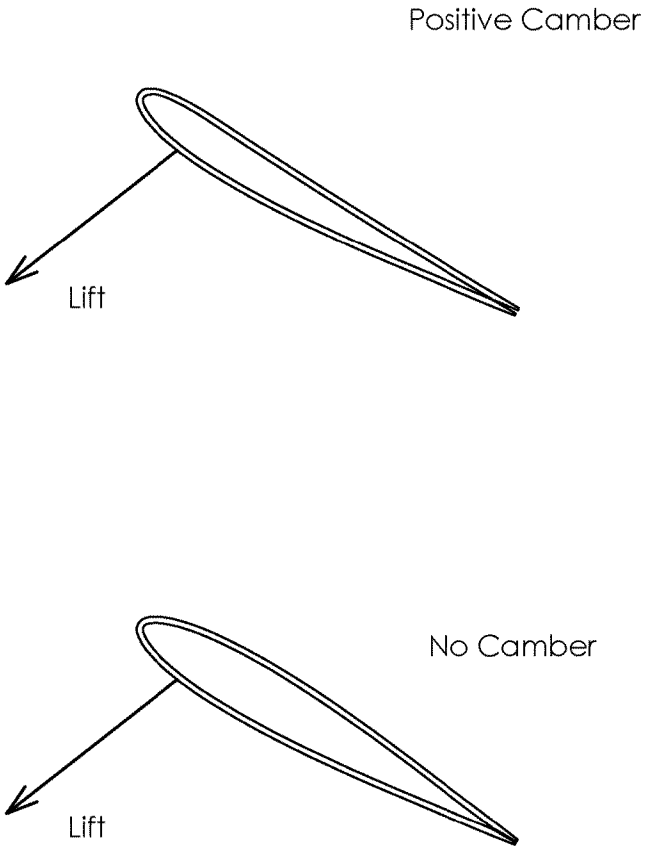

FIG. 13 shows cross sectional views of the fin in a relaxed state and in a deformed state.

DESCRIPTION OF PREFERRED EMBODIMENTS

The fin 1 is essentially a thin sheet of material wrapped around the mast 2. The leading edge 12 is formed where the material is wrapped around the mast 2. The trailing edge 11 is where the two pieces of material meet. The clew 7 is a hole passing through both pieces of material of the fin at the base of the fin near the trailing edge 11. The trailing edge 11 and leading edge 12 of the fin 1 are parallel and the tip end 16 of the fin 1 is parallel to the axis of oscillation 28.

The fin can be injection molded from a single material such as pure nylon or glass filled nylon.

Figure 2:
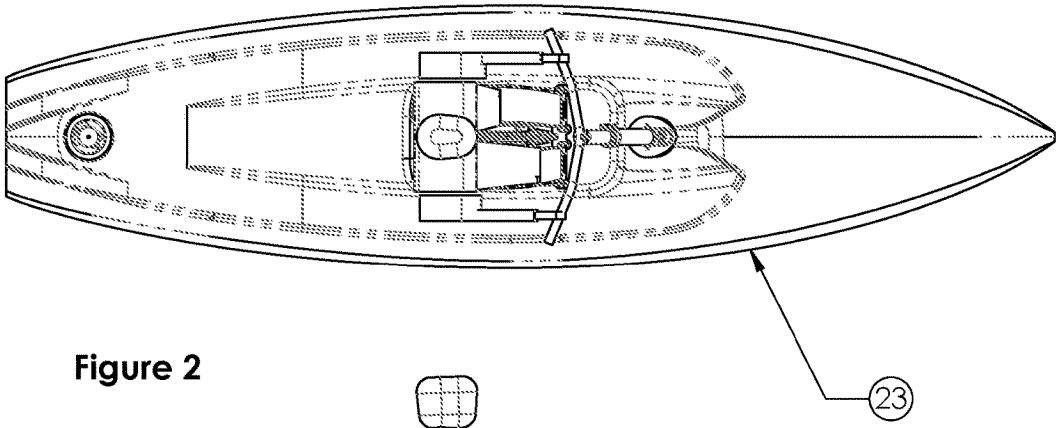
FIG. 1 and FIG. 2 show a side view and a top view of a stand up craft with a drive using the new fin.
Figure 1:
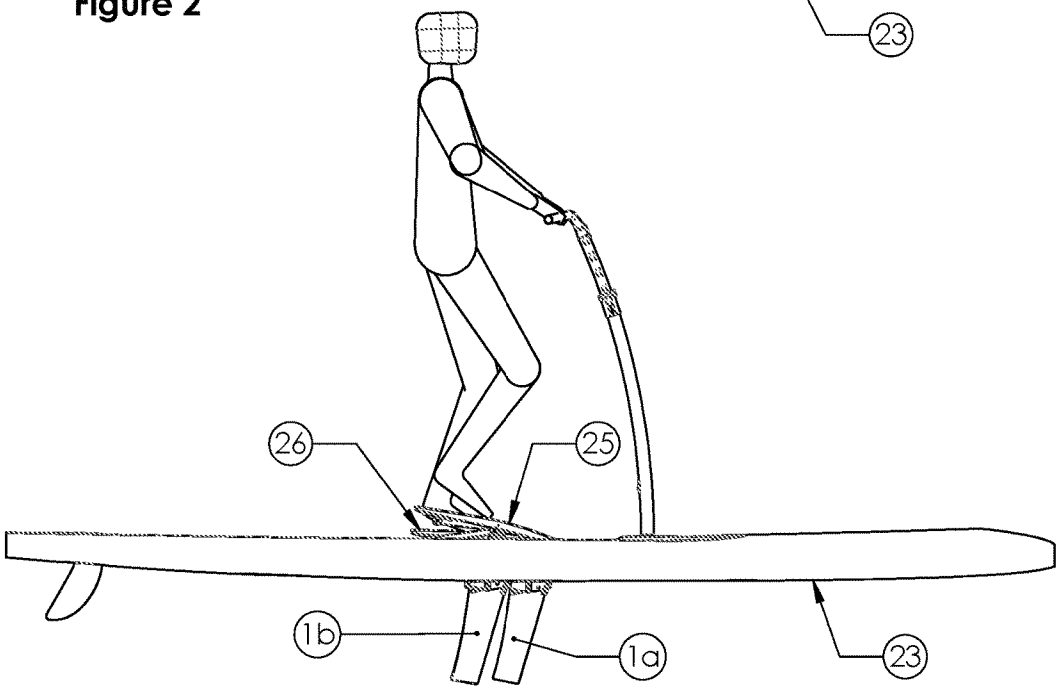
Figure 3:
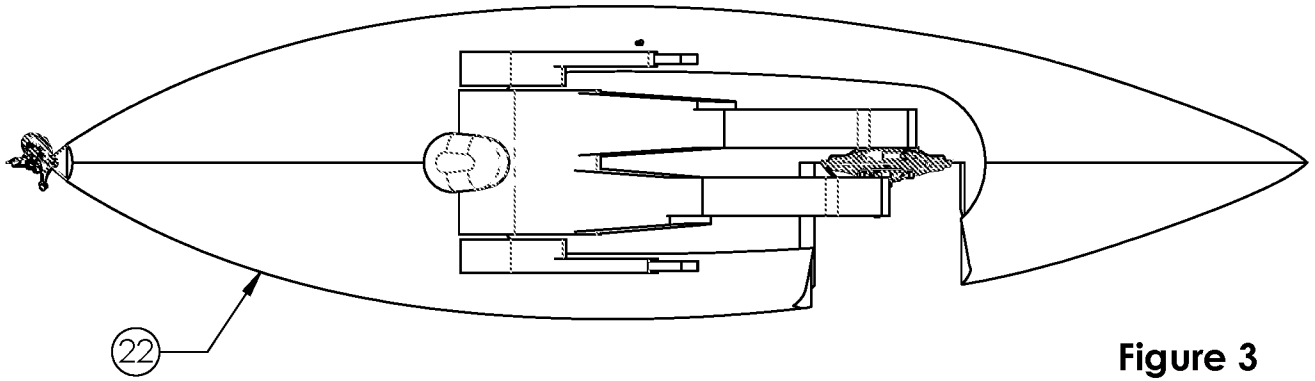
FIG. 3 and FIG. 4 show a side view and a top view of a water craft such as a kayak with a drive using the new fins.
Figure 4:
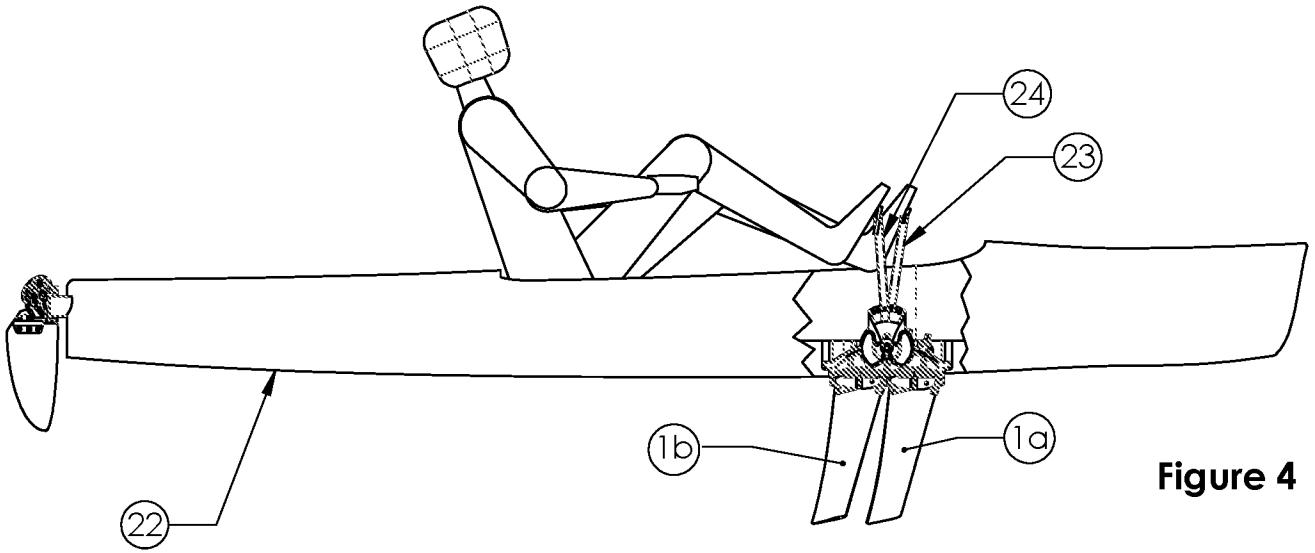

The tip end 16 includes inner pocket 15 which receives the mast 2 on which the fin 1 rotates in an oscillating fashion. The mast 2 is secured to sprocket 17 which is driven by a chain. The entire mechanism shown in the drawings of this patent is inserted through the hull of the kayak 22 or the stand up craft 23 and into the water as shown in FIG. 1 and FIG. 3.

The clew 7 of the fin 1 are connected to the outhaul block 18 with a clevis pin 8 going through the clew 7. The outhaul 18 is free to rotate around the sprocket 6. The front fairing 5 is rigidly attached to sprocket 6 by two screws 4 and serves to reduce the hydrodynamic drag of the assembly.

Means for applying input force is provided by pushing on pedals 23 and 24 which are accessible in the water craft 22 and pedals 25 and 26 which are accessible on the stand up craft 23.

Figure 6:
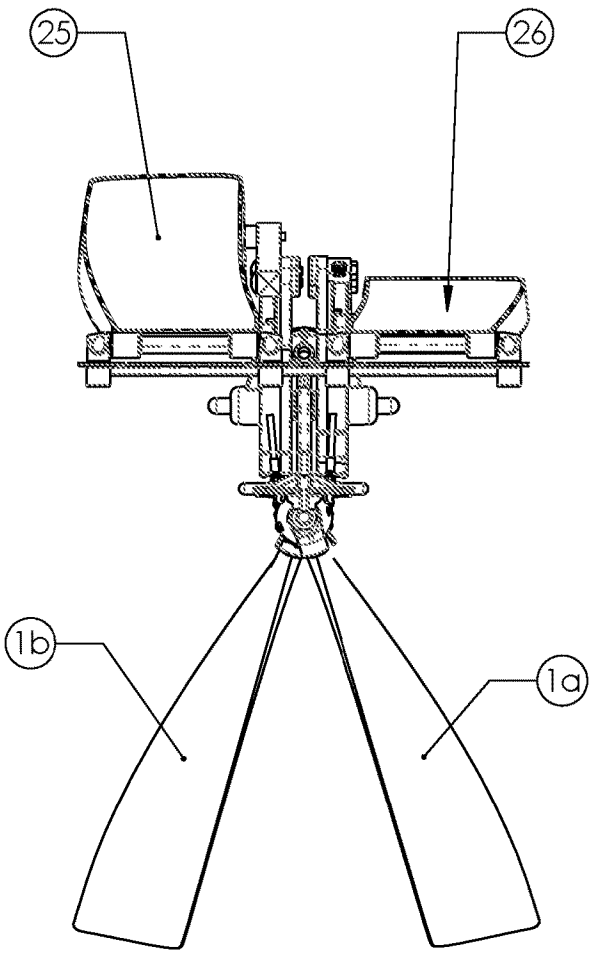
FIG. 5 and FIG. 6 show a side view and a front view of the drive for the stand up craft. The fins are shown in the deformed or twisted condition.
Figure 5:
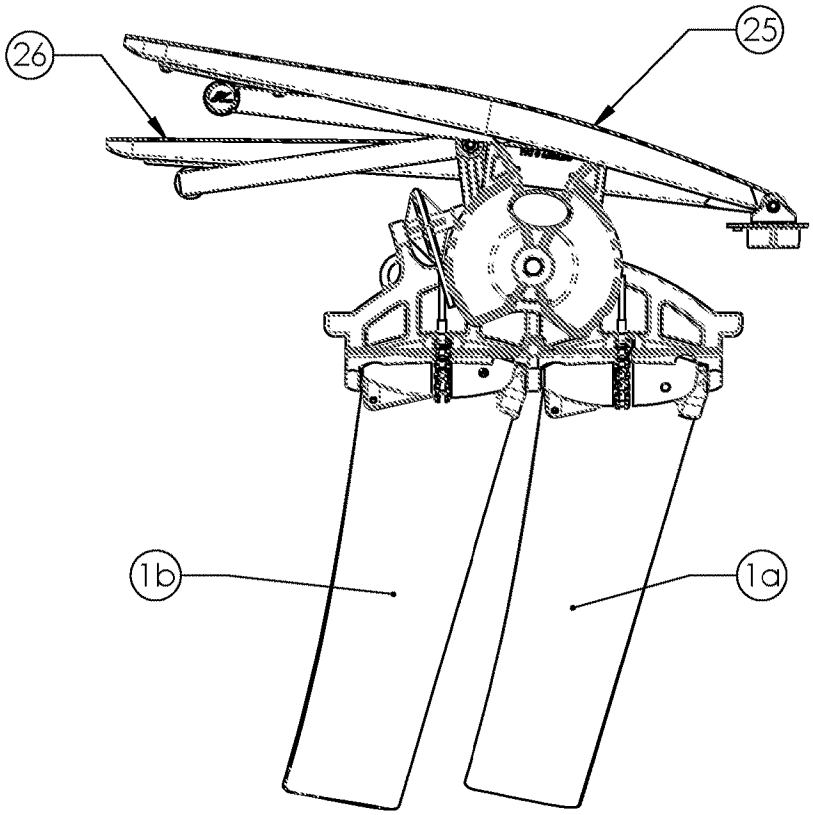
Figure 8:
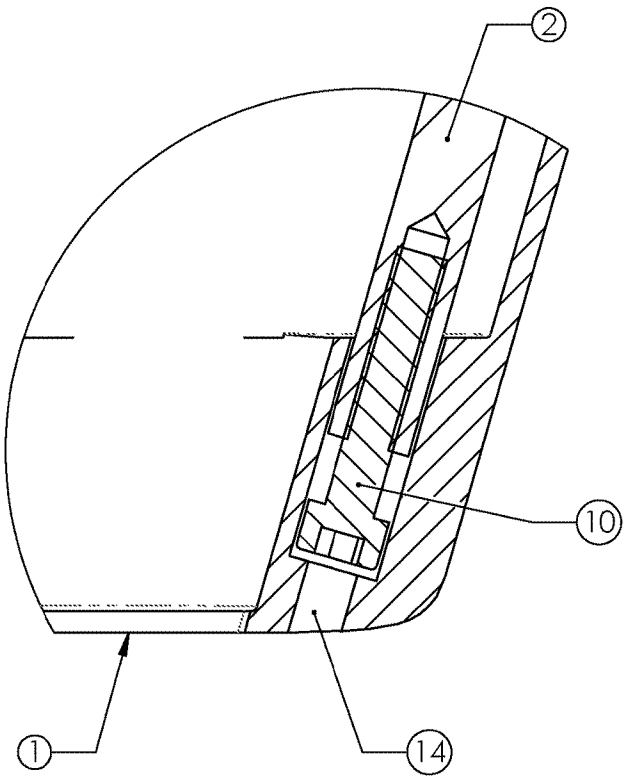
FIG. 8 is a sectional view taken at "a" of FIG. 7.
Figure 7:
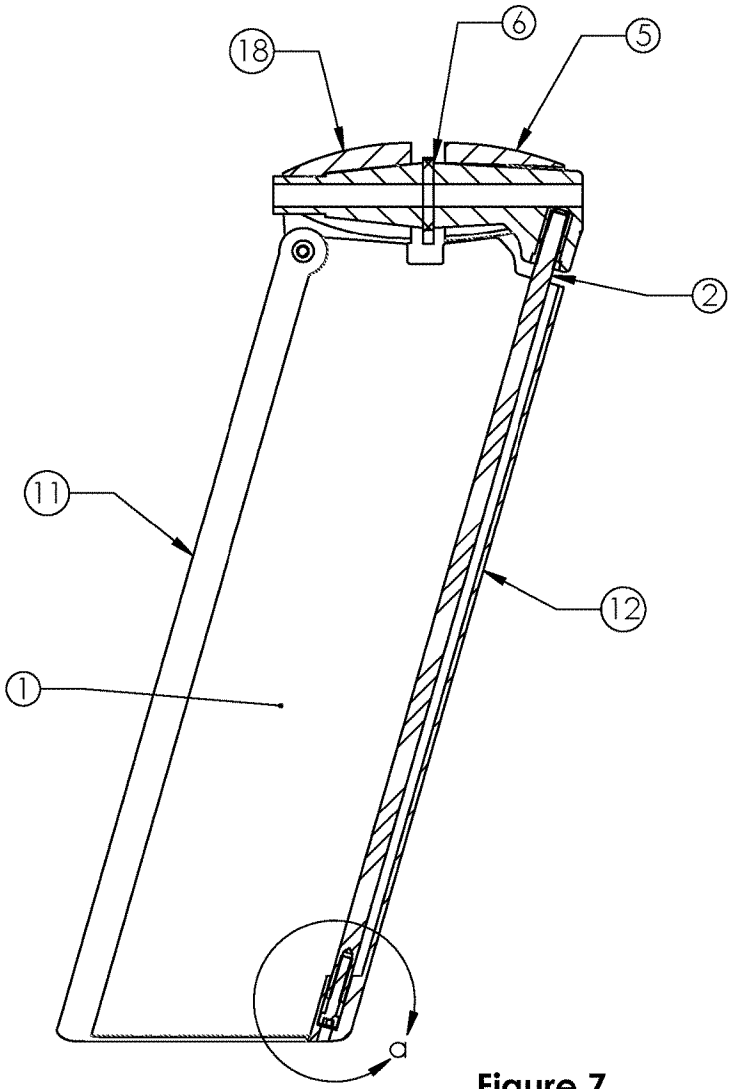
FIG. 7 shows a sectional view of the fin assembly.
Figure 9:
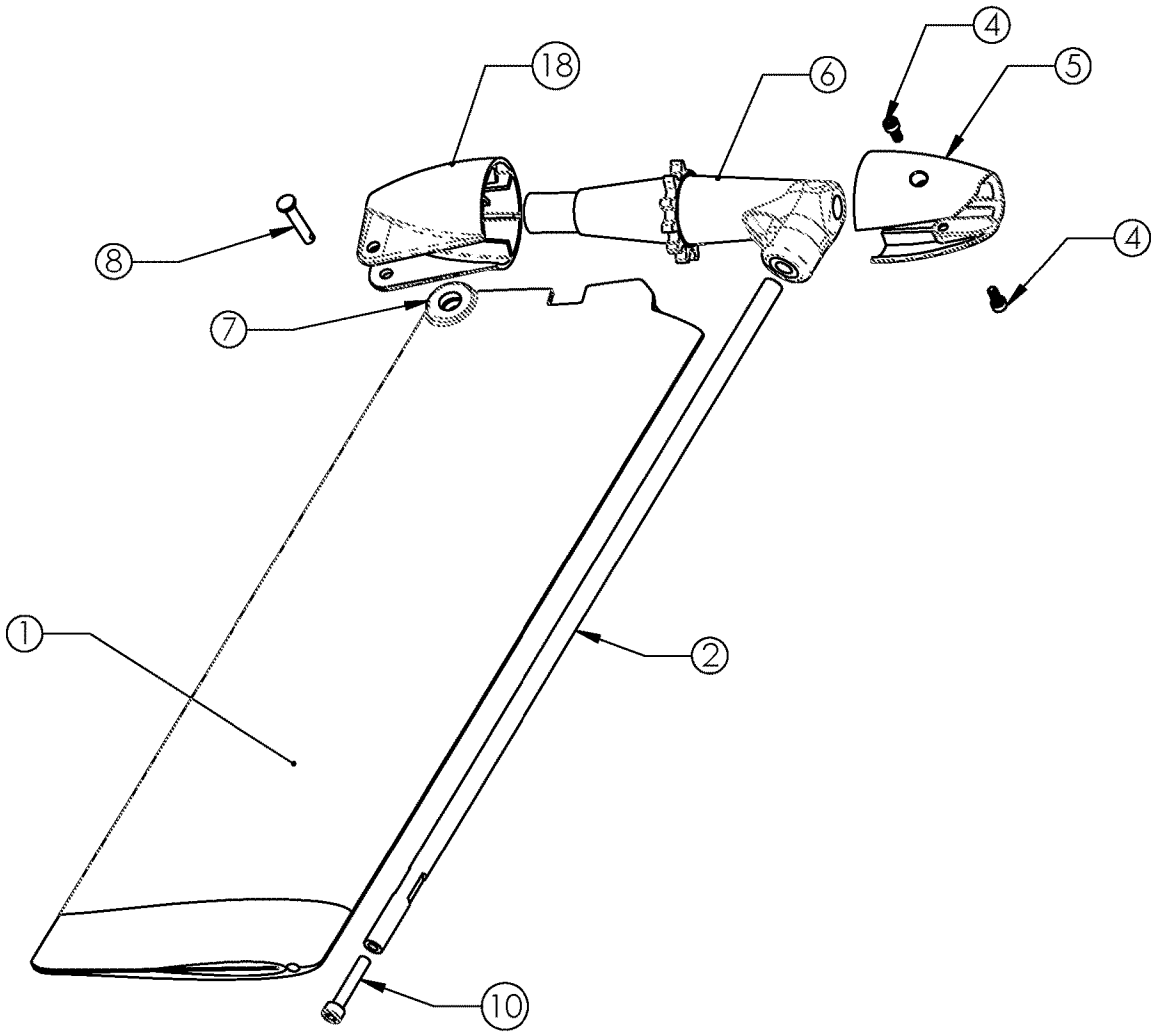
FIG. 9 shows an exploded view of the fin assembly.

It is to be understood that there is a front fin 1*a* and rear fin 1*b*, each with its own sprocket 6, as shown in FIG. 5 and FIG. 6.

The tip of the mast 13 has a an adjustable length means 10, a #10 socket head screw accessible through a hole 14 from the tip end of the fin 1. The user rotates the screw 10 with an allen wrench through the hole 14 to adjust the mast length. The screw 10 stays in contact with the end of the pocket 15 and increases the tension in the fin 1. The clew hole 7 is bigger than the pin 8 allowing the side of the fin not in tension to slide freely. It will be understood then that as the screw 10 is turned in a counter clockwise direction tension in the fin will be increased and the fin will be stiffer.

As shown in FIGS. 10, 11 and 12, the structure of the fin 1 is a hollow chamber made of a single material and is only connected along the leading edge 12. As illustrated in FIG. 11, the section profile of the fin 1 can be identified as a NACA0015. Since the fin is basically a thin piece of material wrapped around the mast 2 it has little resistance to twist.

As shown in FIGS. 11 and 12*a* at the tip the flat sheet of material makes a 90 degree bend to form projections 27, the edges of which touch but are free to slide relative to each other. The projections 27 extend the full or partial cordwise extent of the tip to close the tip and reduce the hydrodynamic drag.

The deformation leads to a cambered profile, illustrated in FIG. 13.

What is claimed:

1. A fin for providing propulsion force to a watercraft having a mast carrying a fin which oscillates through an arcuate path in a generally transverse direction with respect to the central longitudinal dimension of the watercraft, said fin comprising:

a leading edge and a trailing edge, said fin further comprising a sheet of material wrapped around said mast at said leading edge and said sheet of material forming trailing edges that are touching but free to slide relative to each other.

2. The fin of claim 1 which is hollow and has chord-wise flexibility so that said trailing edge has no shear strength.

3. The fin of claim 1 wherein said fin has chord-wise flexibility so that its camber can change.

4. The fin of claim 1 having a constant chord-wise span.

5. The fin of claim 1 wherein said fin has a square tip with rounded corners.

6. A watercraft comprising propulsion means extending below the water line comprising a pair of flexible fins each having a leading edge, a trailing edge and a tip end, each fin being supported at its leading edge by a mast, each said fin being adapted to oscillate through an arcuate path in a generally transverse direction with respect to the central longitudinal dimension of said watercraft, and means operatively associated with said propulsion means for applying input force to said propulsion means whereby as input force is applied said flexible fins can twist to form an angle of attack for providing forward thrust with respect to the longitudinal dimension of the watercraft while moving in both directions along said arcuate path;

the improvement wherein each of said fins comprises a sheet of material wrapped around said mast at said leading edge, said each of said fins having trailing edges that are touching but are free to slide relative to each other, said sheet of material being bent approximately 90° to at least partially close said tip end to form a hollow chamber.

7. A watercraft comprising propulsion means extending below the water line comprising a pair of flexible fins each having a leading edge and a trailing edge, each said fin being supported at its leading edge by a mast, each said fin being adapted to oscillate through an arcuate path in a generally transverse direction with respect to the central longitudinal dimension of said watercraft, and means operatively associated with said propulsion means for applying input force to said propulsion means whereby as input force is applied said flexible fins can twist to form an angle of attack for providing forward thrust with respect to the longitudinal dimension of the watercraft while moving in both directions along said arcuate path;

the improvement wherein each of said fins comprises a sheet of material wrapped around said mast at said leading edge, said each of said fins having trailing edges that are touching but are free to slide relative to each other and having a thick airfoil section profile conforming to NACA0015 to provide more efficient propulsion.

8. A watercraft having propulsion means extending below the water line comprising a pair of flexible fins each having a leading edge and a trailing edge, each fin being supported at its leading edge by a mast, each said fin being adapted to oscillate through an arcuate path in a generally transverse direction with respect to the central longitudinal dimension of said watercraft, and means operatively associated with said propulsion means for applying input force to said propulsion means whereby as input force is applied said flexible fins can twist to form an angle of attack for providing forward thrust with respect to the longitudinal dimension of the watercraft while moving in both directions along said arcuate path;

the improvement wherein each of said fins comprises a sheet of material wrapped around said mast at said leading edge, said each of said fins having trailing edges that are touching but are free to slide relative to each other and said trailing edge being adjustably tensionable, only one of said trailing edges of each said fin being tensioned to enhance deformation, twist and camber of each said fin.

9. The watercraft of claim 8 wherein said watercraft is a pedaled kayak or pedaled stand-up watercraft.

* * * * *